US011033131B2

(12) United States Patent
Garcia

(10) Patent No.: US 11,033,131 B2
(45) Date of Patent: Jun. 15, 2021

(54) GLASSWARE

(71) Applicant: Hanging IP LLC, Seattle, WA (US)

(72) Inventor: Bernardo Garcia, Seattle, WA (US)

(73) Assignee: HANGING IP LLC, Seattle, WA (US)

( * ) Notice: Subject to any disclaimer, the term of this patent is extended or adjusted under 35 U.S.C. 154(b) by 127 days.

(21) Appl. No.: 15/720,876

(22) Filed: Sep. 29, 2017

(65) Prior Publication Data

US 2019/0099022 A1 Apr. 4, 2019

(51) Int. Cl.
*A47G 19/22* (2006.01)
*A47G 23/02* (2006.01)

(52) U.S. Cl.
CPC ..... *A47G 19/2205* (2013.01); *A47G 19/22* (2013.01); *A47G 23/0241* (2013.01)

(58) Field of Classification Search
CPC ... A47G 19/2205; A47G 23/0241; A61J 1/16; A45F 2200/05–0583; B65D 2081/001; B65D 81/00; B65D 81/34; B65D 83/00; B65D 1/02; B65D 13/00; B65D 13/02; B65D 21/00; B65D 21/023
USPC ..... 220/23.83, 23.86, 574, 575, 500, 528, 220/555, 735
See application file for complete search history.

(56) References Cited

U.S. PATENT DOCUMENTS 1,275,467 A * 8/1918 Poulalion ..... A61J 7/0046 604/78
1,393,574 A * 10/1921 Rohmiller ..... A47G 21/145 220/735
1,519,034 A * 12/1924 Livingston ..... A47G 19/2288 215/12.1
1,768,771 A * 7/1930 La Tourrette ..... B65D 25/02 141/380
2,215,691 A * 9/1940 East ..... A45D 27/16 220/501
2,555,053 A * 5/1951 Myrick ..... B44D 3/123 248/113
2,713,952 A 7/1955 Tessen
2,798,230 A 7/1957 Le Febvre et al.
D196,390 S 9/1963 McDermott
D204,702 S 5/1966 Nixon
D217,899 S 6/1970 Lawton
3,619,192 A 11/1971 Land et al.
(Continued)

OTHER PUBLICATIONS

Saverglass, "Single, Spirit Collection" Spirit Catalog, p. 55, downloaded from http://www.saverglass.com/en/downloads, May 2014, 1 page.

(Continued)

*Primary Examiner* — Kareen K Thomas
(74) *Attorney, Agent, or Firm* — Seed Intellectual Property Law Group LLP

(57) ABSTRACT

Glassware such as wine glasses and pint glasses can include a support element configured to support a bottle such as a miniature liquor bottle or a beer bottle in an upside-down or inverted configuration, such that a mouth of the bottle is within the glassware. The support element can be integrally formed with the rest of the glassware. The glassware can be filled with a first beverage and the bottle can be filled with a second beverage and supported on the support element such that the second beverage automatically mixes with the first beverage as the first beverage is consumed.

4 Claims, 8 Drawing Sheets

(56) References Cited

U.S. PATENT DOCUMENTS 3,851,860 A * 12/1974 Smith ..... A47G 19/12 366/130
3,951,486 A * 4/1976 Tracy ..... B60R 7/043 312/235.8
4,009,802 A * 3/1977 Hayduchok ..... B44D 3/128 222/108
4,121,798 A * 10/1978 Schumacher ..... A47L 13/512 24/336
4,271,878 A * 6/1981 Bologa ..... B67C 9/00 141/106
4,854,466 A * 8/1989 Lane, Jr. ..... B65D 25/22 220/23.83
5,022,559 A * 6/1991 Condon ..... B44D 3/121 15/104.94
5,065,966 A * 11/1991 Hartke ..... A47G 23/0241 211/74
D337,920 S * 8/1993 Rowe ..... D7/507
5,435,513 A 7/1995 Davis
5,487,486 A * 1/1996 Meneo ..... A47G 19/127 215/398
D369,279 S 4/1996 Rothschild, III
5,549,074 A 8/1996 Hui
5,664,753 A * 9/1997 Takei ..... A47G 23/0241 248/146
5,702,009 A * 12/1997 Ouellet ..... A47G 23/0241 211/74
5,794,904 A * 8/1998 Hackley ..... A47G 23/0241 248/311.3
6,022,134 A * 2/2000 Andrews ..... B01F 13/002 206/221
6,050,408 A 4/2000 Testa
6,273,283 B1 8/2001 Terrana et al.
D459,848 S * 7/2002 Anderson ..... D32/54
6,502,712 B1 * 1/2003 Weber-Unger .... A47G 19/2205 220/23.83
6,607,088 B2 * 8/2003 Cestrone ..... B65F 1/141 220/23.86
D490,978 S * 6/2004 Breyer ..... D3/313
6,871,825 B2 * 3/2005 Song ..... B44D 3/123 248/110
6,899,236 B2 * 5/2005 Yang ..... A47B 81/00 211/71.01
7,014,078 B2 * 3/2006 Walsh ..... B44D 3/12 222/109
7,165,697 B1 * 1/2007 Checkalski ..... A47G 19/2205 215/6
D562,688 S 2/2008 Mühlhausen et al.
8,042,704 B2 * 10/2011 Borowski ..... G01F 19/002 220/574.1
8,056,755 B2 11/2011 Williams
D650,691 S 12/2011 Miller
D650,692 S * 12/2011 Miller ..... D7/620
8,272,529 B2 * 9/2012 Mansfield ..... B65D 1/265 220/506
8,413,838 B2 4/2013 Miller
D684,472 S 6/2013 Garcia
8,485,378 B2 * 7/2013 Zoss ..... A47G 19/02 220/23.86
8,662,501 B1 * 3/2014 Perales ..... A63B 67/066 273/400
8,690,166 B2 * 4/2014 Peota ..... B62B 3/1472 280/33.992
8,820,572 B2 9/2014 Miller
D715,596 S * 10/2014 Osborne ..... D7/555
8,881,939 B2 * 11/2014 Miller ..... A47G 23/0241 220/737
D731,698 S * 6/2015 Johnson ..... D26/94
9,102,435 B1 * 8/2015 Garcia ..... B65D 1/023
9,365,332 B2 * 6/2016 Jentis ..... G01F 19/002
9,392,895 B2 7/2016 Miller
D801,816 S 11/2017 Garcia
10,531,756 B2 * 1/2020 Miller ..... B67B 7/16
2001/0050283 A1 * 12/2001 Nance ..... A47G 19/04 220/482
2004/0129580 A1 * 7/2004 Cochran ..... A47K 1/09 206/15.2
2006/0156811 A1 * 7/2006 Borowski ..... B65D 77/245 73/426
2007/0102061 A1 * 5/2007 Tsao ..... B65D 77/245 141/380
2007/0267424 A1 * 11/2007 Marks ..... A47G 19/2205 220/703
2008/0149634 A1 * 6/2008 Osborne ..... A47G 21/145 220/23.83
2009/0272753 A1 * 11/2009 Rebelak, Sr. ..... G09F 23/06 220/737
2010/0018984 A1 * 1/2010 Solomon ..... B65D 23/0842 220/739
2010/0140431 A1 * 6/2010 Van Horne ..... B65D 23/001 248/274.1
2010/0200582 A1 * 8/2010 Hammerle ..... A47J 43/27 220/4.27
2011/0094991 A1 * 4/2011 Klein ..... B65D 51/249 215/395
2011/0233219 A1 * 9/2011 Proskey ..... F25D 3/08 220/592.17
2011/0247994 A1 10/2011 Siciliano
2012/0234845 A1 * 9/2012 Miller ..... A47G 19/22 220/737
2012/0279964 A1 * 11/2012 McGeough ..... B65D 51/247 220/212
2013/0081364 A1 * 4/2013 Piscopo ..... B65D 43/169 53/492
2013/0200086 A1 * 8/2013 Miller ..... A47G 19/22 220/709
2013/0220969 A1 8/2013 Miller
2013/0306664 A1 * 11/2013 Miller ..... A47G 19/22 220/737
2014/0082914 A1 3/2014 Flores
2014/0097183 A1 * 4/2014 McGrath ..... B65D 43/169 220/212

OTHER PUBLICATIONS

Saverglass, "Winch, Spirit Collection" Spirit Catalog, p. 69, downloaded from http://www.saverglass.com/en/downloads, May 2014, 1 page.

* cited by examiner

GLASSWARE

BACKGROUND

Technical Field

This disclosure relates to containers and receptacles for dispensing liquids and beverages. More particularly, this disclosure relates to systems for hanging inverted containers for dispensing liquids into mixed drinks and cocktails.

Description of the Related Art

Mixed drinks and cocktails are a lucrative product for bars and restaurants. A bartender or other member of a restaurant or bar's waitstaff typically makes or creates a mixed drink using spirits, wines, beers, and other ingredients behind a bar or otherwise away from their patron's tables. After making the drink, a bartender or server may present the completed drink to the patron.

A recent phenomenon has occurred where mixed drinks or cocktails have incorporated bottled ingredients including additional alcoholic or non-alcoholic bottled beverages such that the additional alcoholic or nonalcoholic bottled beverages slowly leave the bottle and combine with the beverage in a drink glass or other beverage receptacle as the patron consumes the drink. Some of these drinks are made by simply inverting a beer, liquor, wine, or other bottle into a drink glass or other beverage receptacle that contains a partially mixed drink. Inverting a bottle into a glass or other beverage receptacle is not a reliable way to create these sorts of mixed drinks, because the bottles are unstable, the outsides of the bottles may be dirty, and they may contain paper labels or other decorations that are not designed to be wet. These paper labels and decorations may weaken or fall off the bottle when the bottle is submerged in the drink.

Moreover, bars and restaurants serve certain types of drinks in particularly shaped containers. As bartenders innovate and create new drinks, the drinks may be ideally served in a particularly shaped container that is not conducive to simply inverting a bottle and putting it in the drink container. For example, inverting a miniature spirits container in a beer stein could cause the miniature spirits container to drop to the bottom and be completely submerged in the container.

Some restaurants and bars may use bottle holders to hold the inverted bottle in a container. However, these bottle holders require sourcing of many parts to create one drink, are susceptible to theft, and are cumbersome for bartenders and servers at restaurants and bars.

BRIEF SUMMARY

A variety of beverage containers are described herein. Beverage containers can include a glass, such as a wine glass or a pint glass, with support elements for supporting a bottle. A bottle can be inverted and supported on the support elements such that, as one drinks a beverage held in the glass, another beverage held within the bottle empties into the glass.

A beverage container for supporting an inverted bottle may be summarized as comprising: a wall defining at least a portion of an interior cavity of the beverage container to receive liquid and having an upper rim at a top end thereof; and a support element that is integrally formed with an inner surface of the wall and that extends from the inner surface into the interior cavity of the beverage container, the support element configured to support the inverted bottle such that a mouth of the inverted bottle is within the interior cavity.

The entire beverage container can be a single piece of glass or a single piece of plastic. The beverage container can be configured as a wine glass or a pint glass. The support element can include an opening sized to support the inverted bottle. The support element can have a toroidal structure. The support element can have a pair of semi-circular arms. The support element can have a hook. The support element can have a pair of prongs. The support element can have a straight bar that is coupled at a first end to the inner surface of the wall and that is coupled at a second end opposite to the first end to the inner surface of the wall. The support element can include a vertical bar sized to extend into the mouth of the inverted bottle. The wall can have a circular or rectangular cross-sectional profile. The support element can extend from the inner surface of the wall at a location below the upper rim and the support element can be contained entirely within the interior cavity.

A beverage container arrangement may be summarized as comprising: a glass having a wall defining at least a portion of an interior cavity of the beverage container to receive liquid, an upper rim at a top end of the wall defining a mouth of the glass leading to the interior cavity, and a support element that is integrally formed with an inner surface of the wall and that extends from the inner surface of the wall into the interior cavity; and an inverted bottle supported at least in part by the support element such that a mouth of the inverted bottle is within the interior cavity. The inverted bottle can be an inverted beer bottle or an inverted miniature liquor bottle.

A method may be summarized as comprising: pouring a primary beverage into a glass having a support element integrally formed therein; filling a bottle with a secondary beverage or otherwise providing the bottle in a pre-filled state; and supporting the bottle in an inverted orientation on the support element integrally formed in the glass, such that a mouth of the inverted bottle is submerged beneath the level of the primary beverage in the glass.

The method can further comprise: presenting the combination of the glass and inverted bottle to a customer, such that the secondary beverage drains from the bottle into the glass and mixes with the primary beverage as the customer consumes the primary beverage from the glass. The primary beverage and the secondary beverage can be alcoholic beverages. The primary beverage can be a margarita. The secondary beverage can be tequila.

DETAILED DESCRIPTION

In the following description, certain specific details are set forth in order to provide a thorough understanding of various embodiments of the invention. However, one skilled in the art will understand that the invention may be practiced without these details. In other instances, well-known structures and steps associated with containers have not been shown or described in detail to avoid unnecessarily obscuring descriptions of the embodiments of the invention.

As used herein, terms of relative elevation, such as "top," "bottom," "upper," lower," "above," and "below," are used in their ordinary sense, that is, with respect to a direction of a gravitational force, such that liquids are drawn by gravity to flow from a first location toward a second location below the first location.

Figure 1A:
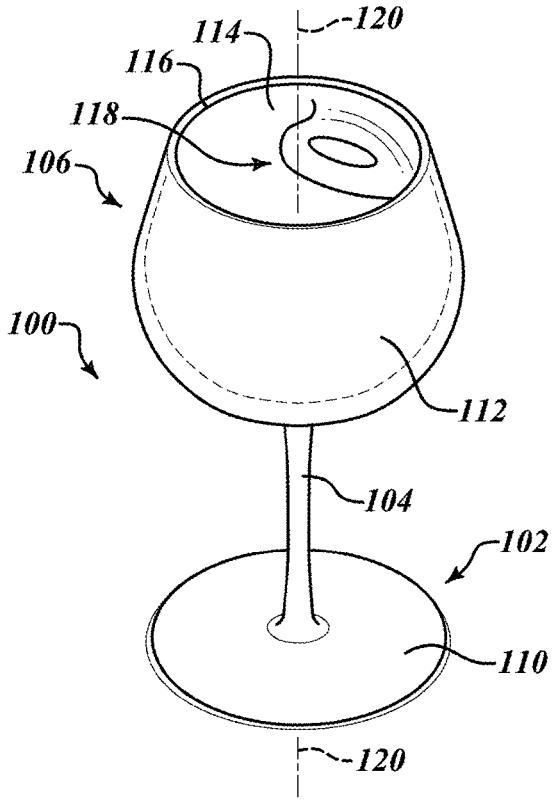
FIG. 1A illustrates a perspective view of a piece of glassware, according to an example embodiment.
Figure 2A:
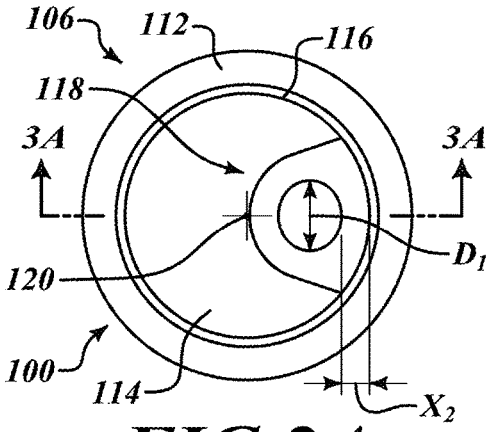
FIG. 2A illustrates a top view of the piece of glassware of FIG. 1A.
Figure 3A:
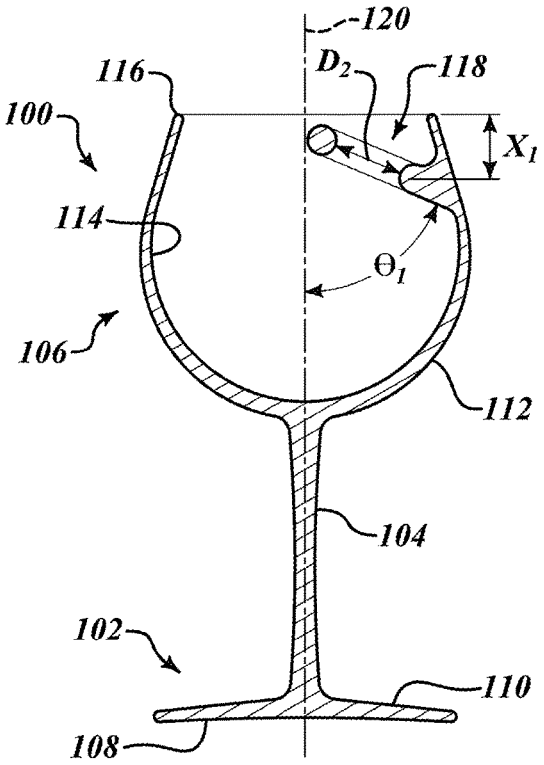
FIG. 3A illustrates a cross-sectional side view of the piece of glassware of FIG. 1A taken along line 3A-3A in FIG. 2A.

FIGS. 1A, 2A, and 3A illustrate perspective, top, and cross-sectional side views, respectively, of a first embodiment of a beverage receptacle or container, which can be a piece of glassware such as a wine glass 100. As shown in FIGS. 1A, 2A, and 3A, the glass 100 includes a base portion or foot 102 at its bottom end, a stem 104 directly physically coupled to the foot 102, a bowl 106 directly physically coupled to the stem 104, and a support element 118 directly physically coupled to the bowl 106. The foot 102 includes a flat, planar bottom surface 108 and a top surface 110. A bottom end of the stem 104 is directly physically coupled to the top surface 110 of the foot, and a bottom end of the bowl 106 is directly physically coupled to a top end of the stem 104. When the glass 100 is in use, its flat bottom surface 108 can be positioned on a flat support surface, such as an upper surface of a table, and a beverage such as water, juice, wine, etc., can be poured into the bowl 106 for consumption by a consumer.

As illustrated in FIGS. 1A, 2A, and 3A, the foot 102, the stem 104, and the bowl 106 are rotationally, radially, and circularly symmetric about a central longitudinal axis 120 that extends vertically through the centers of the foot 102, the stem 104, and the bowl 106. That is, the glass 100, other than the support element 118, is rotationally, radially, and circularly symmetric about the central longitudinal axis 120. The central longitudinal axis 120 can be coincident with a central longitudinal axis of the foot 102, a central longitudinal axis of the stem 104, and a central longitudinal axis of the bowl 106.

The foot 102, the stem 104, and the bowl 106 have generally circular cross-sectional shapes when viewed along the axis 120, such that the foot 102 has a shape generally comprising a relatively flat disk, the stem 104 has a shape generally comprising a relatively elongate cylinder, and the bowl 106 has a shape generally comprising a truncated portion of a hollow and generally spherical structure. Thus, the foot 102, the stem 104, and the bowl 106 are circularly symmetric about the central longitudinal axis 120, meaning that they are continuously rotationally symmetric about the axis 120, or rotationally symmetric about the axis 120 by any degree of rotation. In other implementations, however, a beverage receptacle or container such as a piece of glassware can have other shapes. For example, the components of a piece of glassware can have generally square, hexagonal, or other cross-sectional shapes when viewed along the axis 120, such that the components of the piece of glassware have a 4-, 6-, or greater degree of rotational symmetry, but not circular symmetry.

FIGS. 1A, 2A, and 3A illustrate that the bowl 106 of the glass 100 includes a curved wall having an outer surface 112, an inner surface 114, and an upper rim 116, which can be the top-most portion of the glass 100, and from which a beverage can be poured as it is consumed by the consumer. FIGS. 1A, 2A, and 3A also illustrate that the glass 100 includes the support element 118, which can be a ring 118, and which is coupled to the inner surface 114 of the bowl 106. The ring 118 can be toroidal, can have a shape comprising a solid torus, and/or can be hollow. The ring 118 can extend inward from the inner surface 114 of the bowl 106 toward the central longitudinal axis 120 of the glass 100.

The ring 118 can be monolithically or integrally formed with the bowl 106 and the rest of the glass 100. That is, the ring 118 and the bowl 106 can be collectively composed of exactly one integral element, without mechanical or other fasteners or adhesives coupling multiple parts together. Further, the ring 118, the foot 102, the stem 104, and the bowl 106 can be collectively composed of exactly one integral element, without mechanical or other fasteners or adhesives coupling multiple parts together. The entire glass 100, including the bowl 106 and the ring 118, can be made of a single piece of material such as a single piece of glass, plastic, acrylic, clay, or other suitable material, and therefore can similarly have any desired flexibility or rigidity.

For example, the ring 118, the bowl 106, and/or the rest of the glass 100 can be fabricated in a single injection molding process, by cooling a single piece of molten glass, in a single glass-blowing process, or by first fabricating the ring 118 and the rest of the glass 100 independently of one another, and then joining the ring 118 with the rest of the glass 100 through a process that renders the ring 110 and the rest of the glass 100 integral with one another. For example, the ring 118 can be coupled to the rest of the glass 100 by heating the portions of the ring 118 and the rest of the glass 100 that are to be coupled to one another until they are molten, and then coupling the molten portion of the ring 118 to the molten portion of the rest of the glass 110 and allowing the respective molten portions to cool.

FIGS. 2A and 3A also illustrate several dimensions of the ring 118. For example, as shown in FIG. 2A, the ring 118 can have a maximum inner distance $D_1$ when viewed from above along the axis 120, and as shown in FIG. 3A, the ring 118 can have an inner distance $D_2$ when viewed in the plane including both line 3A-3A in FIG. 2A and the axis 120. In some embodiments, the inner distances $D_1$ and $D_2$ can be the same, or can be within 1%, 2%, 3%, 5%, 10%, or 15% of one another, so that an opening at the center of the ring 118 can be circular or substantially circular. The inner distances $D_1$ and $D_2$ can be configured to allow portions of a bottle, such as portions of a miniature liquor bottle or portions of a beer bottle, to extend, in an inverted configuration, through the opening at the center of the ring 118. As examples, the inner distances $D_1$ and $D_2$ can be greater than 10 mm, greater than 15 mm, greater than 20 mm, greater than 25 mm, or greater than 30 mm, and less than 15 mm, less than 20 mm, less than 25 mm, less than 30 mm, or less than 35 mm.

Further, as illustrated in FIG. 3A, the ring 118 may be inclined, with respect to a horizontal plane, as it extends away from the inner surface 114 of the bowl 106 toward the center of the bowl 106. For example, FIG. 3A illustrates that the ring 118 is aligned to extend at an angle $\Theta_1$ with respect to the axis 120, such that the ring 118 also extends at an angle that is $\Theta_1$ less than 90° with respect to a horizontal plane. As specific examples, $\Theta_1$ can be greater than 60°, greater than 65°, greater than 70°, greater than 75°, greater than 80°, or greater than 85°, and less than 90°, less than 85°, less than 80°, less than 75°, less than 70°, or less than 65°. In some alternative implementations, the ring 118 is not inclined with respect to a horizontal plane, and is horizontal, as it extends away from the inner surface 114 of the bowl 106 toward the center of the bowl 106.

Further, as illustrated in FIG. 3A, the ring 118 is coupled to the inner surface 114 of the bowl 106 at a location below the rim 116 of the bowl 106 by a distance $X_1$, as measured from the rim 116 of the bowl 106 to the mid-point of the portion of the ring 118 that is coupled to the inner surface of the bowl 106 in the direction of the axis 120. The distance $X_1$ is large enough that, while the ring 118 is inclined upward as it extends away from the inner surface 114 of the bowl 106, the rim 116 of the bowl 106 is still the top-most portion of the glass 100, which can facilitate storage of the glass 100 in an upside-down configuration. As specific examples, the distance X1 can be greater than 10 mm, greater than 15 mm, greater than 20 mm, greater than 25 mm, or greater than 30 mm, and less than 15 mm, less than 20 mm, less than 25 mm, less than 30 mm, or less than 35 mm. In some alternative implementations, the ring 118 can be coupled to the inner surface 114 of the bowl 106 at or adjacent to the rim 116 of the bowl 106, such that the distance $X_1$ is equal to half a thickness of the ring 118 in the direction of the axis 120.

Further, as illustrated in FIG. 2A, the ring 118 can have an inner periphery defining the opening at the center of the ring 118, which can be positioned so that an entirety of the inner periphery of the ring 118 is closer to the central longitudinal axis 120 than an entirety of the rim 116 of the bowl 106, and so that a minimum distance $X_2$ is defined between the inner periphery of the ring 118 and the rim 116 of the bowl 106, when they are viewed from above along the axis 120. As examples, the distance $X_2$ can be greater than 5 mm, greater than 10 mm, greater than 15 mm, greater than 20 mm, greater than 25 mm, or greater than 30 mm, and less than 10 mm, less than 15 mm, less than 20 mm, less than 25 mm, less than 30 mm, or less than 35 mm. The inner diameters $D_1$ and $D_2$ and the distance $X_2$ can be configured to allow portions of a bottle, such as portions of a miniature liquor bottle or portions of a beer bottle, to extend, in an inverted configuration, through the opening at the center of the ring 118 and rest against the rim 116 of the bowl 106, so that the bottle can be stably supported by such components of the glass 100.

Figure 1B:
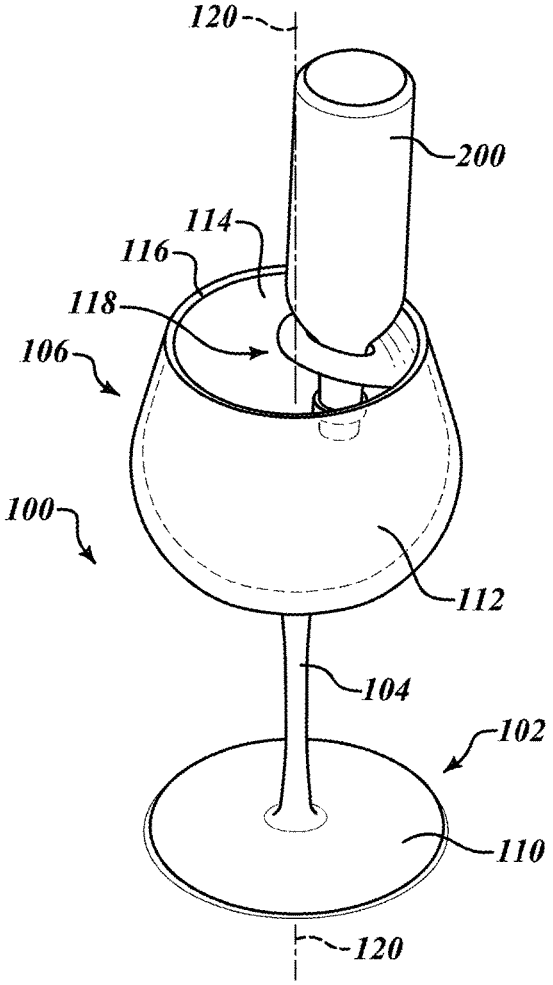
FIG. 1B illustrates a perspective view of the piece of glassware of FIG. 1A, with a bottle coupled to the piece of glassware.
Figure 2B:
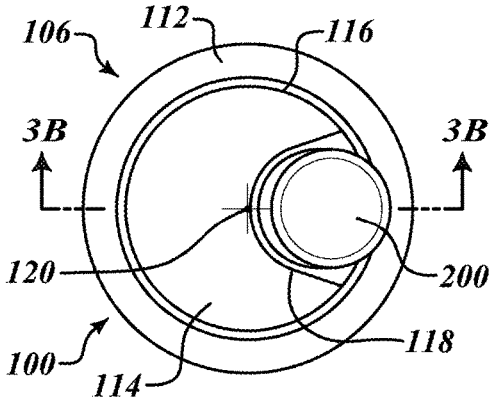
FIG. 2B illustrates a top view of the piece of glassware of FIG. 1A, with a bottle coupled to the piece of glassware.
Figure 3B:
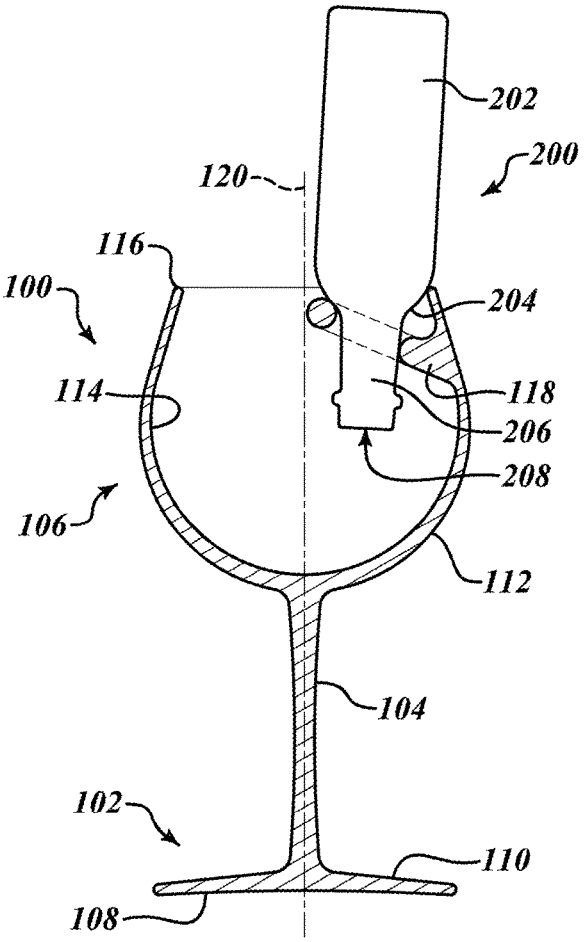
FIG. 3B illustrates a cross-sectional side view of the piece of glassware of FIG. 1A, with a bottle coupled to the piece of glassware, taken along line 3B-3B in FIG. 2B.

FIGS. 1B, 2B, and 3B illustrate the glass 100 in the same views and orientations as in FIGS. 1A, 2A, and 3A, respectively, but with a bottle, which can be a beer bottle or a miniature liquor bottle 200, supported by the support element 118 and the rim 116 of the bowl 106. Miniature liquor bottles are generally configured to hold about 50 ml of a liquor or other liquid, but otherwise have relatively variable dimensions. As some examples, the miniature liquor bottle 200 can have a main body 202 with a main body diameter, a shoulder 204, a neck 206 with a neck diameter, and a mouth 208. The neck diameter can be less than the main body diameter such that the shoulder 204 forms a tapered portion that decreases in diameter between the main body 202 and the neck 206. Thus, the bottle 200 can be inverted and the mouth 208 and neck 206 can extend through the opening at the center of the ring 118 while the shoulder 204 and the main body 202 cannot, so that the bottle 200 can be supported by the ring 118 and the rim 116 in an inverted or upside-down configuration as shown in FIGS. 1B, 2B, and 3B.

A method of using the glass 100 and the bottle 200 can include pouring one or more primary consumable liquids or beverages, such as the ingredients of an alcoholic mixed drink such as a margarita, into the bowl 106 of the glass 100 and filling the bottle 200 with one or more secondary consumable liquids or beverages, such as an alcoholic beverage such as tequila, or otherwise providing a pre-filled bottle 200. The method can also include turning the bottle 200 upside-down and supporting the bottle 200 in the upside-down orientation on the ring 118 and the rim 116 of the glass 100, with the mouth 208 of the bottle 200 submerged beneath the level of the primary liquids in the bowl 106 of the glass 100. For example, the mouth 208 and neck 206 of the bottle 200 can extend through the opening at the center of the ring 118 while the shoulder 204 and/or the main body 202 rest on the ring 118, so that the bottle 200 is supported by the ring 118 and the rim 116 in the inverted or upside-down configuration. The method can also include presenting such a beverage to a consumer or customer for consumption. As the consumer drinks or otherwise empties the primary liquids from the bowl 106, the secondary liquids stored within the bottle 200 will automatically drain from the bottle 200 into the bowl 106 of the glass 100, where they can mix with the primary liquids. Such a beverage can provide an enjoyable and exciting experience for the consumer.

Figure 4A:
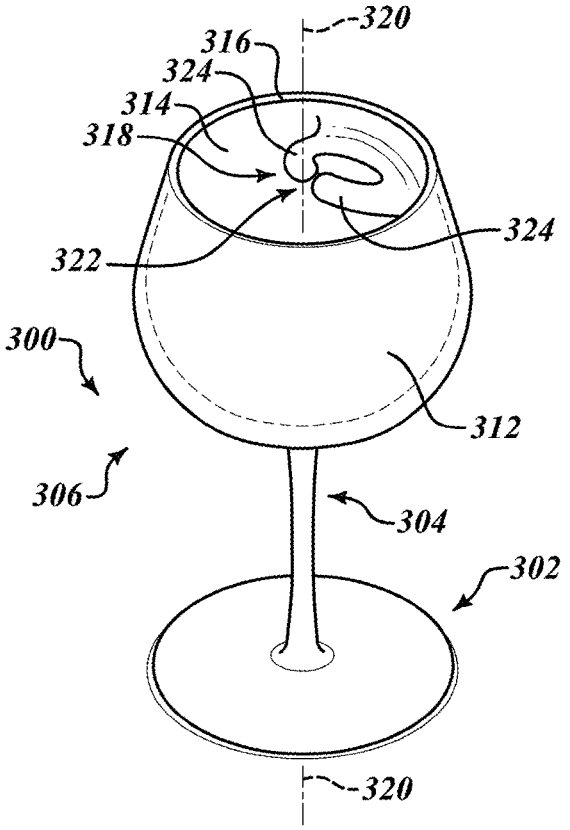
FIG. 4A illustrates a perspective view of a piece of glassware, according to another example embodiment.
Figure 5A:
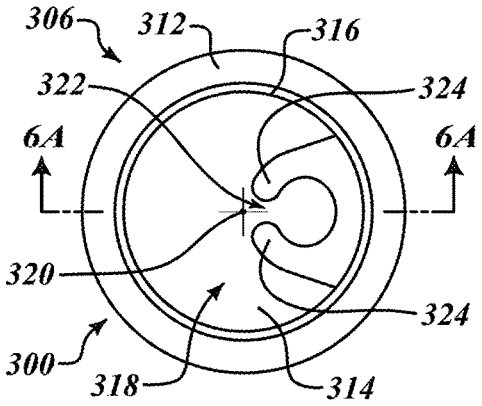
FIG. 5A illustrates a top view of the piece of glassware of FIG. 4A.
Figure 6A:
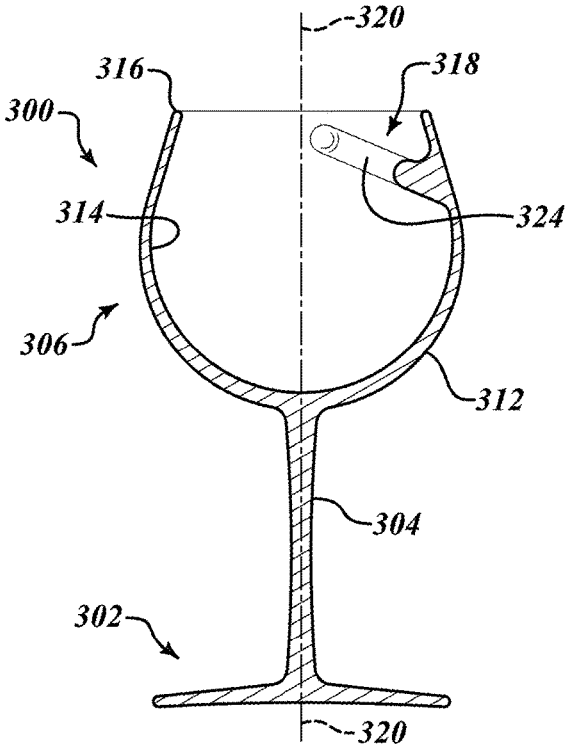
FIG. 6A illustrates a cross-sectional side view of the piece of glassware of FIG. 4A taken along line 6A-6A in FIG. 5A.

FIGS. 4A, 5A, and 6A illustrate perspective, top, and cross-sectional side views, respectively, of a second embodiment of a beverage receptacle or container, which can be a piece of glassware such as a wine glass 300. The glass 300 can share many of the features described above for the glass 100, and some common features are not described for the glass 300 to avoid unnecessary duplication of descriptions. The description of glass 300 that follows focuses on features of glass 300 that are different from those of glass 100. As shown in FIGS. 4A, 5A, and 6A, the glass 300 includes a foot 302, a stem 304, and a bowl 306, which are rotationally, radially, and circularly symmetric about a central longitudinal axis 320, as well as a support element 318.

The bowl 306 of the glass 300 includes an outer surface 312, an inner surface 314, and an upper rim 316. The support element 318 is coupled to the inner surface 314 of the bowl 306. The support element 318 can be toroidal or ring-shaped with a gap 322 at an end thereof opposite to the end thereof that is coupled to the inner surface 314 of the bowl 306. The support element 318 can also include a pair of semi-circular arms 324 that extend outward from the inner surface 314 of the bowl 306 toward one another and toward the center of the bowl 306 to enclose or substantially enclose a circular or substantially circular opening at the center of the support element 318. The gap 322 can have a width corresponding to a minimum distance between the terminal end portions of the arms 324, which can be greater than 1 mm, greater than 2 mm, greater than 5 mm, greater than 10 mm, or greater than 15 mm, and less than 20 mm, less than 15 mm, less than 10 mm, less than 5 mm, or less than 2 mm, and which can represent greater than 1°, greater than 2°, greater than 3°, greater than 5°, greater than 10°, greater than 15°, greater than 25°, or greater than 30°, and less than 35°, less than 30°, less than 25°, less than 20°, less than 15°, less than 10°, less than 5°, less than 3°, or less than 2° of the circular, ring, or toroidal shape of the support element 318.

Figure 4B:
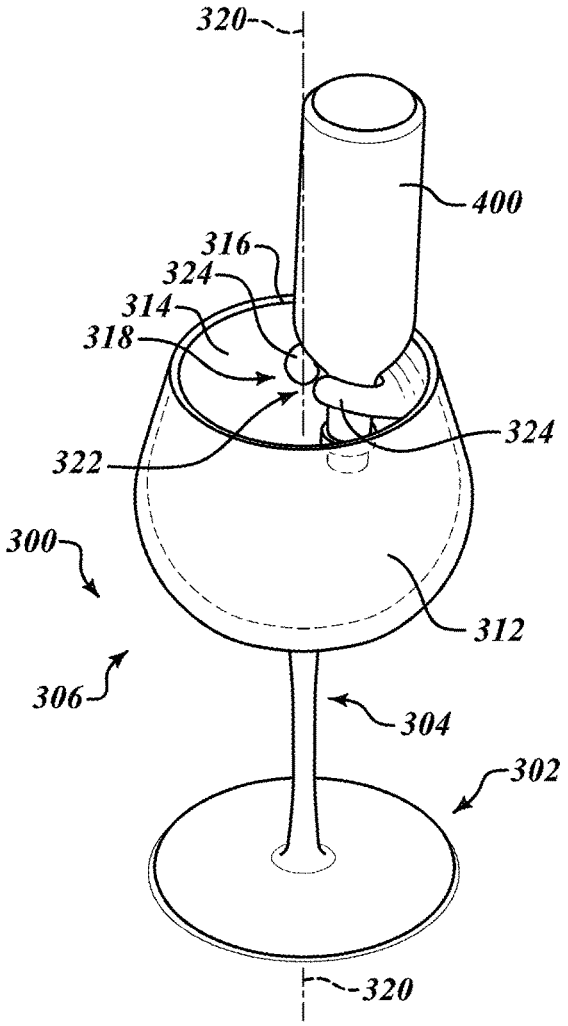
FIG. 4B illustrates a perspective view of the piece of glassware of FIG. 4A, with a bottle coupled to the piece of glassware.
Figure 5B:
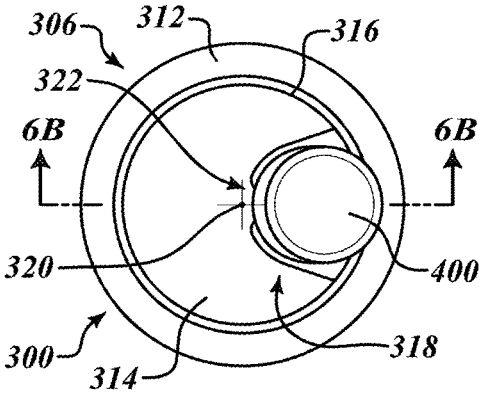
FIG. 5B illustrates a top view of the piece of glassware of FIG. 4A, with a bottle coupled to the piece of glassware.
Figure 6B:
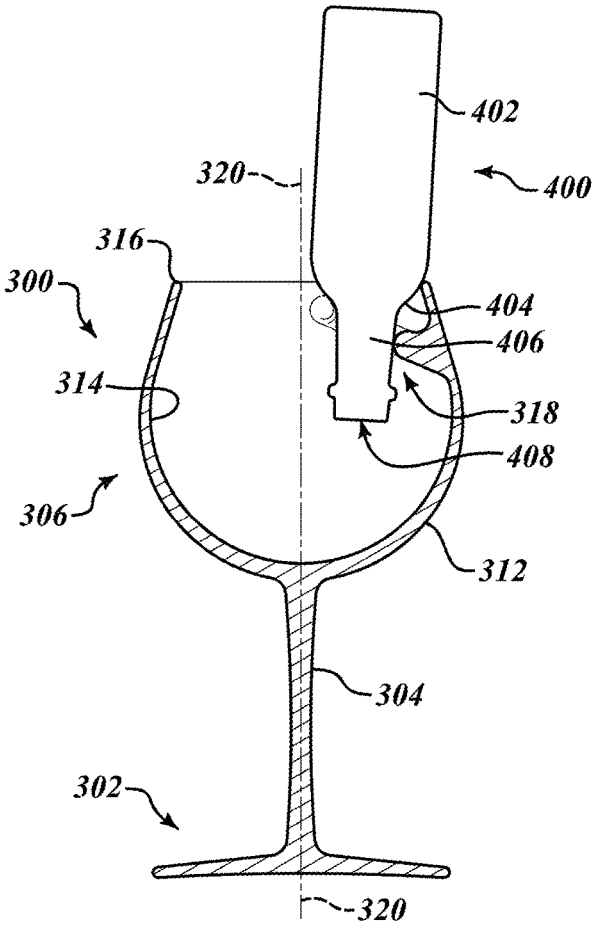
FIG. 6B illustrates a cross-sectional side view of the piece of glassware of FIG. 4A, with a bottle coupled to the piece of glassware, taken along line 6B-6B in FIG. 5B.

FIGS. 4B, 5B, and 6B illustrate the glass 300 in the same views and orientations as in FIGS. 4A, 5A, and 6A, respectively, but with a bottle, which can be a beer bottle or a miniature liquor bottle 400, supported by the support element 318 and the rim 316 of the bowl 306. The bottle 400 can share many of the features described above for the bottle 200, and some common features are not described for the bottle 400 to avoid unnecessary duplication of descriptions.

A method of using the glass 300 and the bottle 400 can include pouring one or more primary consumable liquids or beverages into the bowl 306 of the glass 300 and filling the bottle 400 with one or more secondary consumable liquids or beverages, or otherwise providing a pre-filled bottle 400. The method can also include turning the bottle 400 upside-down and supporting the bottle 400 in the upside-down orientation on the support element 318 and the rim 316 of the glass 300, with a mouth 408 of the bottle 400 submerged beneath the level of the primary liquids in the bowl 306 of the glass 300. For example, the mouth 408 and a neck 406 of the bottle 400 can extend through the opening at the center of the support element 318 while a shoulder 404 and/or a main body 402 of the bottle 400 rest on the support element 318, so that the bottle 400 is supported by the support element 318 and the rim 316 in the inverted or upside-down configuration. The method can also include presenting such a beverage to a consumer or customer for consumption. As the consumer drinks or otherwise empties the primary liquids from the bowl 306, the secondary liquids stored within the bottle 400 will automatically drain from the bottle 400 into the bowl 306 of the glass 300, where they can mix with the primary liquids. Such a beverage can provide an enjoyable and exciting experience for the consumer.

Figure 7:
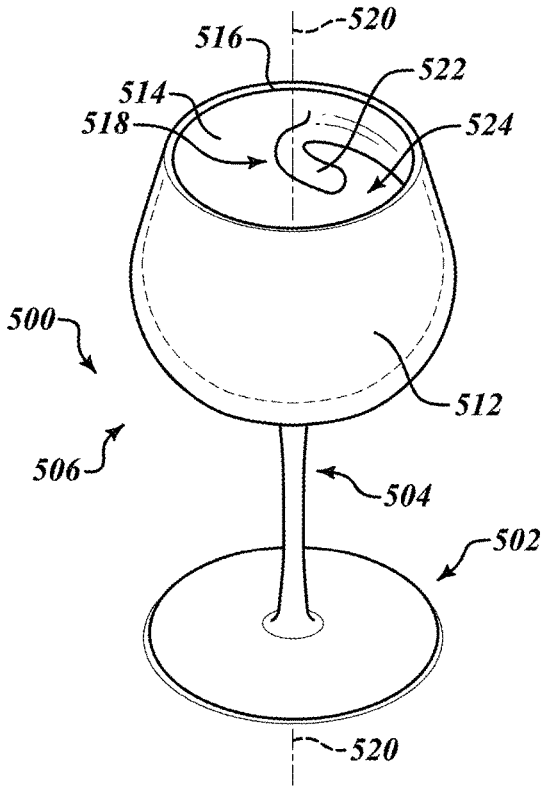
FIG. 7 illustrates a perspective view of a piece of glassware, according to another example embodiment.
Figure 8:
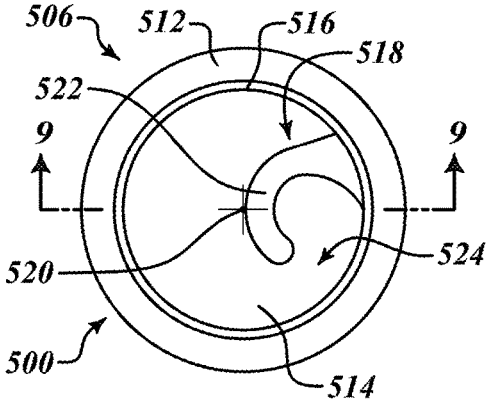
FIG. 8 illustrates a top view of the piece of glassware of FIG. 7.
Figure 9:
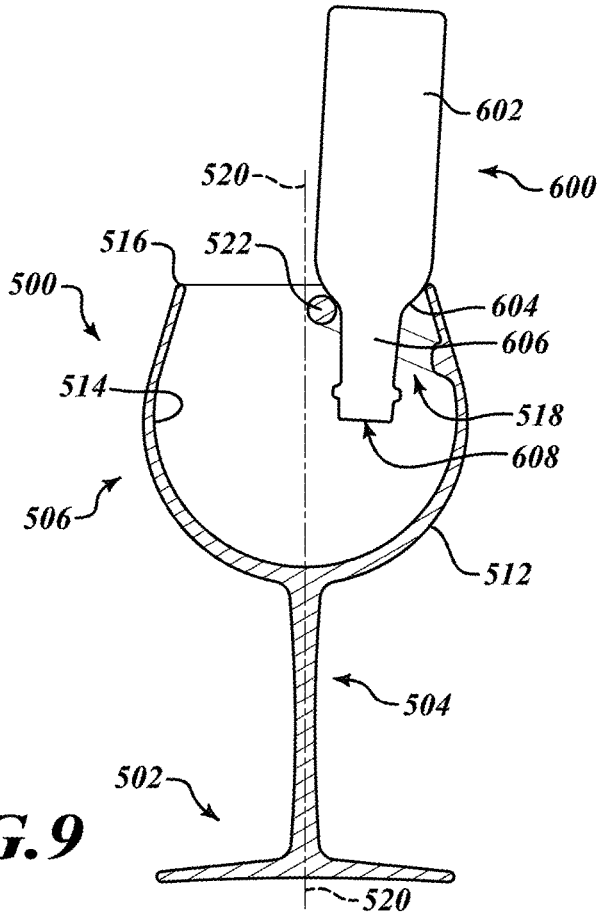
FIG. 9 illustrates a cross-sectional side view of the piece of glassware of FIG. 7, with a bottle coupled to the piece of glassware, taken along line 9-9 in FIG. 8.

FIGS. 7, 8, and 9 illustrate perspective, top, and cross-sectional side views, respectively, of a third embodiment of a beverage receptacle or container, which can be a piece of glassware such as a wine glass 500, and a bottle, which can be a beer bottle or a miniature liquor bottle 600, supported by the glass 500. The glass 500 can share many of the features described above for the glass 100 and the glass 300, and some common features are not described for the glass 500 to avoid unnecessary duplication of descriptions. Similarly, the bottle 600 can share many of the features described above for the bottles 200 and 400, and some common features are not described for the bottle 600 to avoid unnecessary duplication of descriptions. The description of glass 500 and the bottle 600 that follows focuses on features of glass 500 and the bottle 600 that are different from those of glasses 100 and 300 and bottles 200 and 400.

As shown in FIGS. 7, 8, and 9, the glass 500 includes a foot 502, a stem 504, and a bowl 506, which are rotationally, radially, and circularly symmetric about a central longitudinal axis 520, as well as a support element 518. The bowl 506 of the glass 500 includes an outer surface 512, an inner surface 514, and an upper rim 516. The support element 518 is coupled to the inner surface 514 of the bowl 506. The support element 518 can have a shape comprising a portion of a torus or a portion of a ring, such that the support element 518 forms an arm or a hook 522 that extends outward from the inner surface 514 of the bowl 506 and leaves a gap 524 between a terminal end portion of the arm or hook of the support element 518 and the inner surface 514 of the bowl 506, and that encloses or substantially encloses a circular or substantially circular opening at the center of the support element 518.

The gap 524 can have a width corresponding to a minimum distance between the terminal end portion of the arm or hook of the support element 518 and the inner surface 514 of the bowl 506, which can be greater than 5 mm, greater than 10 mm, greater than 15 mm, greater than 20 mm, greater than 25 mm, or greater than 30 mm, and less than 35 mm, less than 30 mm, less than 25 mm, less than 20 mm, less than 15 mm, or less than 10 mm, and which can represent greater than 15°, greater than 30°, greater than 45°, greater than 60°, or greater than 75°, and less than 90°, less than 75°, less than 60°, less than 45°, or less than 30° of the circular, ring, or toroidal shape of the support element 518.

A method of using the glass 500 and the bottle 600 can include pouring one or more primary consumable liquids or beverages into the bowl 506 of the glass 500 and filling the bottle 600 with one or more secondary consumable liquids or beverages, or otherwise providing a pre-filled bottle 600. The method can also include turning the bottle 600 upside-down and supporting the bottle 600 in the upside-down orientation on the support element 518 and the rim 516 of the glass 500, with a mouth 608 of the bottle 600 submerged beneath the level of the primary liquids in the bowl 506 of the glass 500. For example, the mouth 608 and a neck 606 of the bottle 600 can extend through the opening at the center of the support element 518 while a shoulder 604 and/or a main body 602 of the bottle 600 rest on the support element 518, so that the bottle 600 is supported by the support element 518 and the rim 516 in the inverted or upside-down configuration. The method can also include presenting such a beverage to a consumer or customer for consumption. As the consumer drinks or otherwise empties the primary liquids from the bowl 506, the secondary liquids stored within the bottle 600 will automatically drain from the bottle 600 into the bowl 506 of the glass 500, where they can mix with the primary liquids. Such a beverage can provide an enjoyable and exciting experience for the consumer.

Figure 10:
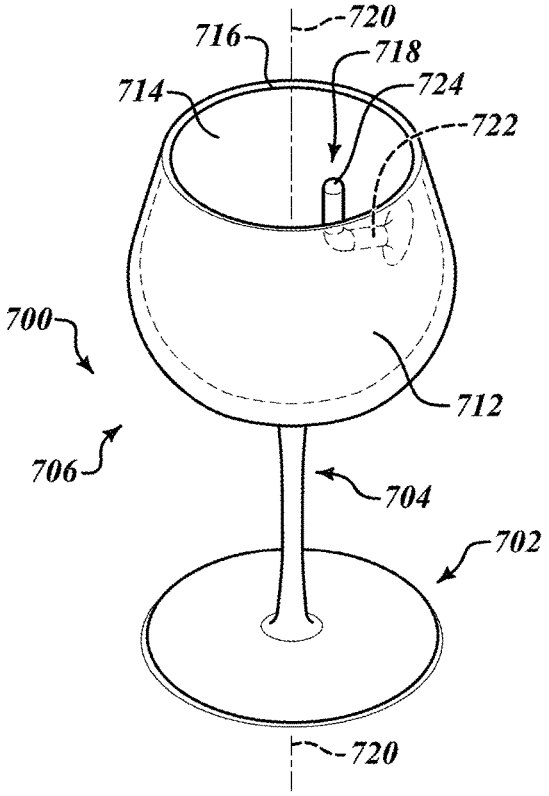
FIG. 10 illustrates a perspective view of a piece of glassware, according to another example embodiment.
Figure 11:
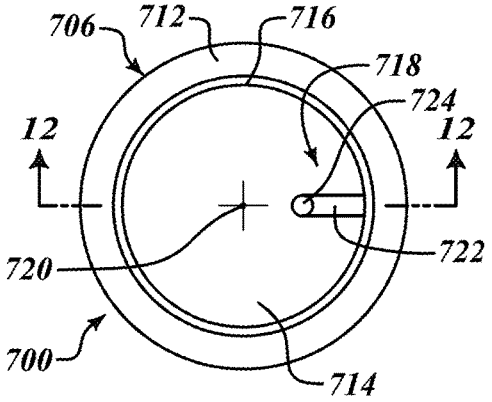
FIG. 11 illustrates a top view of the piece of glassware of FIG. 10.
Figure 12:
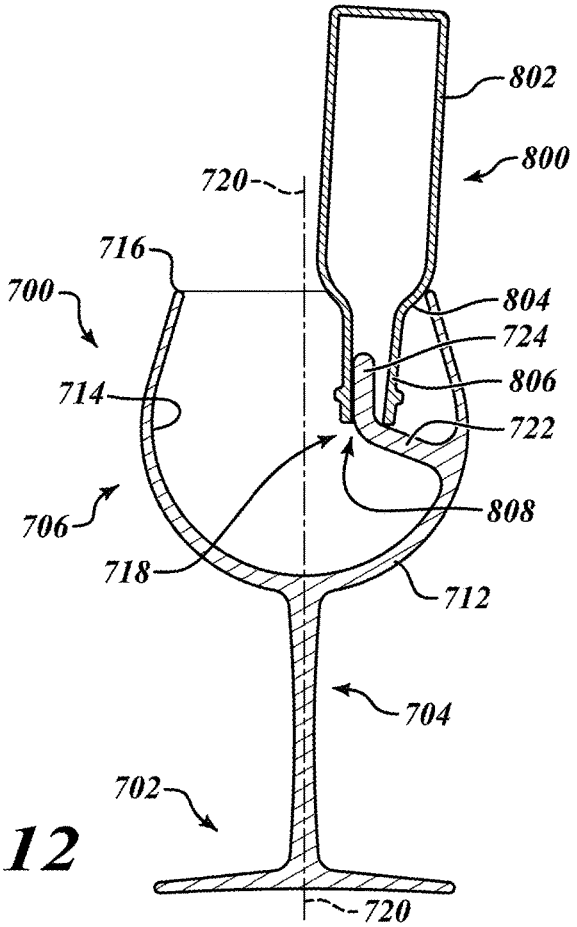
FIG. 12 illustrates a cross-sectional side view of the piece of glassware of FIG. 10, with a bottle coupled to the piece of glassware, taken along line 12-12 in FIG. 11.

FIGS. 10, 11, and 12 illustrate perspective, top, and cross-sectional side views, respectively, of a fourth embodiment of a beverage receptacle or container, which can be a piece of glassware such as a wine glass 700, and a bottle, which can be a beer bottle or a miniature liquor bottle 800, supported by the glass 700. The glass 700 can share many of the features described above for the glasses 100, 300, and 500, and some common features are not described for the glass 700 to avoid unnecessary duplication of descriptions. Similarly, the bottle 800 can share many of the features described above for the bottles 200, 400, and 600, and some common features are not described for the bottle 800 to avoid unnecessary duplication of descriptions. The description of glass 700 and the bottle 800 that follows focuses on features of glass 700 and the bottle 800 that are different from those of glasses 100, 300, and 500 and bottles 200, 400, and 600.

As shown in FIGS. 10, 11, and 12, the glass 700 includes a foot 702, a stem 704, and a bowl 706, which are rotationally, radially, and circularly symmetric about a central longitudinal axis 720, as well as a support element 718. The bowl 706 of the glass 700 includes an outer surface 712, an inner surface 714, and an upper rim 716. The support element 718 is coupled to the inner surface 714 of the bowl 706. The support element 718 can include a first bar 722 directly coupled to the inner surface 714 of the bowl 706 at a first end of the first bar 722, and a second bar 724 directly coupled at a first end of the second bar 724 to a second end of the first bar 722 opposite to the first end of the first bar 722. The first bar 722 extends straight out from the inner surface 714 of the bowl 706 toward the central longitudinal axis 720 of the glass 700, and the second bar 724 extends straight upward from its connection to the first bar 722.

A method of using the glass 700 and the bottle 800 can include pouring one or more primary consumable liquids or beverages into the bowl 706 of the glass 700 and filling the bottle 800 with one or more secondary consumable liquids or beverages, or otherwise providing a pre-filled bottle 800. The method can also include turning the bottle 800 upside-down and supporting the bottle 800 in the upside-down orientation on the support element 718 and the rim 716 of the glass 700. For example, the second bar 724 of the support element 718 can extend into a mouth 808 and/or a neck 806 of the bottle 800 such that the mouth 808 and the neck 806 of the bottle 800 are held up by and rest on the first bar 722 and are held in position and restrained against lateral motion by the second bar 724, while a main body 802 and/or a shoulder 804 of the bottle 800 lean against and are supported by the rim 716 of the glass 700.

In such a configuration, the mouth 808 of the bottle 800 can be submerged beneath the level of the primary liquids in the bowl 706 of the glass 700. The method can also include presenting such a beverage to a consumer or customer for consumption. As the consumer drinks or otherwise empties the primary liquids from the bowl 706, the secondary liquids stored within the bottle 800 will automatically drain from the bottle 800 into the bowl 706 of the glass 700, where they can mix with the primary liquids. Such a beverage can provide an enjoyable and exciting experience for the consumer.

Figure 13:
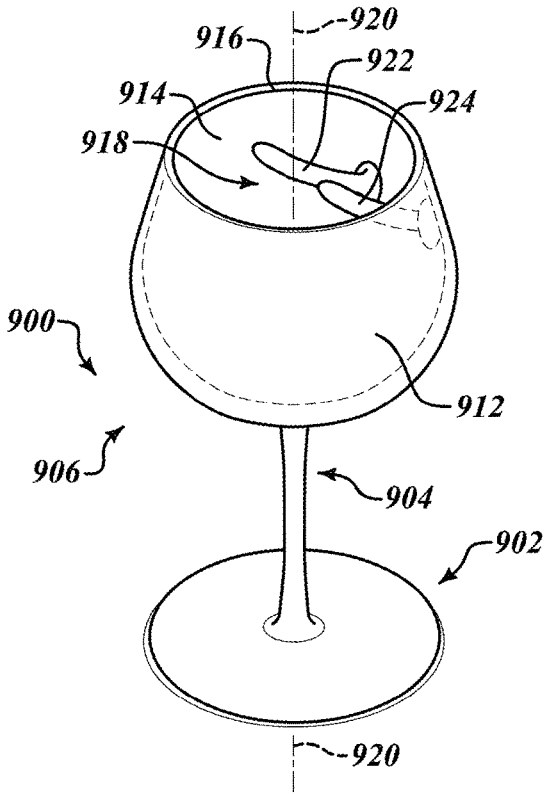
FIG. 13 illustrates a perspective view of a piece of glassware, according to another example embodiment.
Figure 14:
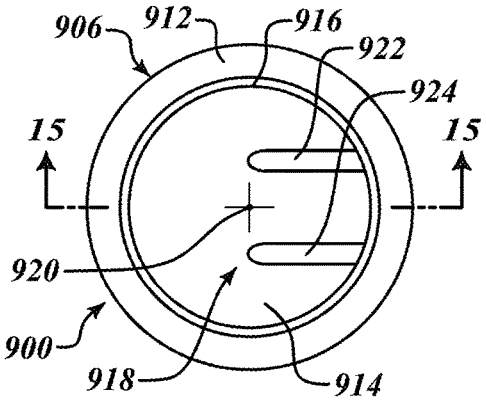
FIG. 14 illustrates a top view of the piece of glassware of FIG. 13.
Figure 15:
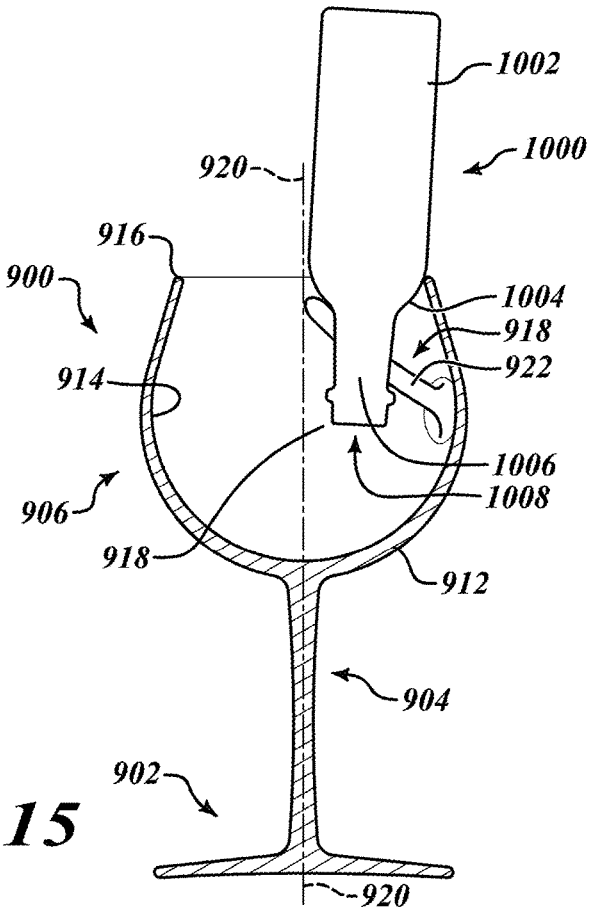
FIG. 15 illustrates a cross-sectional side view of the piece of glassware of FIG. 13, with a bottle coupled to the piece of glassware, taken along line 15-15 in FIG. 14.

FIGS. 13, 14, and 15 illustrate perspective, top, and cross-sectional side views, respectively, of a fifth embodiment of a beverage receptacle or container, which can be a piece of glassware such as a wine glass 900, and a bottle, which can be a beer bottle or a miniature liquor bottle 1000, supported by the glass 900. The glass 900 can share many of the features described above for the glasses 100, 300, 500, and 700, and some common features are not described for the glass 900 to avoid unnecessary duplication of descriptions. Similarly, the bottle 1000 can share many of the features described above for the bottles 200, 400, 600, and 800, and some common features are not described for the bottle 1000 to avoid unnecessary duplication of descriptions. The description of glass 900 and the bottle 1000 that follows focuses on features of glass 900 and the bottle 1000 that are different from those of glasses 100, 300, 500, and 700 and bottles 200, 400, 600, and 800.

As shown in FIGS. 13, 14, and 15, the glass 900 includes a foot 902, a stem 904, and a bowl 906, which are rotationally, radially, and circularly symmetric about a central longitudinal axis 920, as well as a pair of support elements 918. The bowl 906 of the glass 900 includes an outer surface 912, an inner surface 914, and an upper rim 916. The support elements 918 are coupled to the inner surface 914 of the bowl 906. The support elements 918 can include a first bar, hook, or prong 922 directly coupled to the inner surface 914 of the bowl 906 at a first end of the first prong 922, and a second bar, hook, or prong 924 directly coupled to the inner surface 914 of the bowl 906 at a first end of the second prong 924. The first and second prongs 922, 924 extend parallel to one another and outward from the inner surface 914 of the bowl 906 toward a central portion of the glass 900 with an upward curvature, and are spaced apart from one another such that a mouth 1008 and a neck 1006 of the bottle 1000 can pass between the two prongs 922 and 924, while a main body 1002 and a shoulder 1004 of the bottle 1000 cannot.

A method of using the glass 900 and the bottle 1000 can include pouring one or more primary consumable liquids or beverages into the bowl 906 of the glass 900 and filling the bottle 1000 with one or more secondary consumable liquids or beverages, or otherwise providing a pre-filled bottle 1000. The method can also include turning the bottle 1000 upside-down and supporting the bottle 1000 in the upside-down orientation on the support elements 918 and the rim 916 of the glass 900, with the mouth 808 of the bottle 800 submerged beneath the level of the primary liquids in the bowl 906 of the glass 900. For example, the mouth 1008 and neck 1006 of the bottle 1000 can extend between the two prongs 922 and 924 while the shoulder 1004 and/or the main body 1002 of the bottle 1000 rest on top of the prongs 922 and 924, so that the bottle 1000 is supported by the two prongs 922 and 924, and by the rim 916, in the inverted or upside-down configuration.

In such a configuration, the mouth 1008 of the bottle 1000 can be submerged beneath the level of the primary liquids in the bowl 906 of the glass 900. The method can also include presenting such a beverage to a consumer or customer for consumption. As the consumer drinks or otherwise empties the primary liquids from the bowl 906, the secondary liquids stored within the bottle 1000 will automatically drain from the bottle 1000 into the bowl 906 of the glass 900, where they can mix with the primary liquids. Such a beverage can provide an enjoyable and exciting experience for the consumer.

Figure 16:
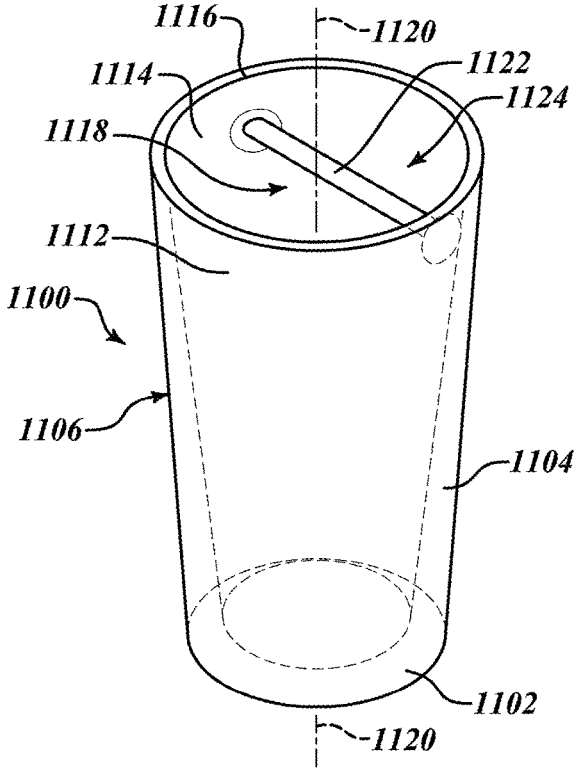
FIG. 16 illustrates a perspective view of a piece of glassware, according to yet another example embodiment.
Figure 17:
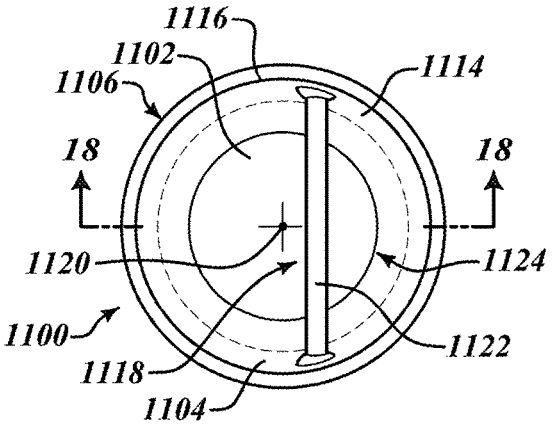
FIG. 17 illustrates a top view of the piece of glassware of FIG. 16.
Figure 18:
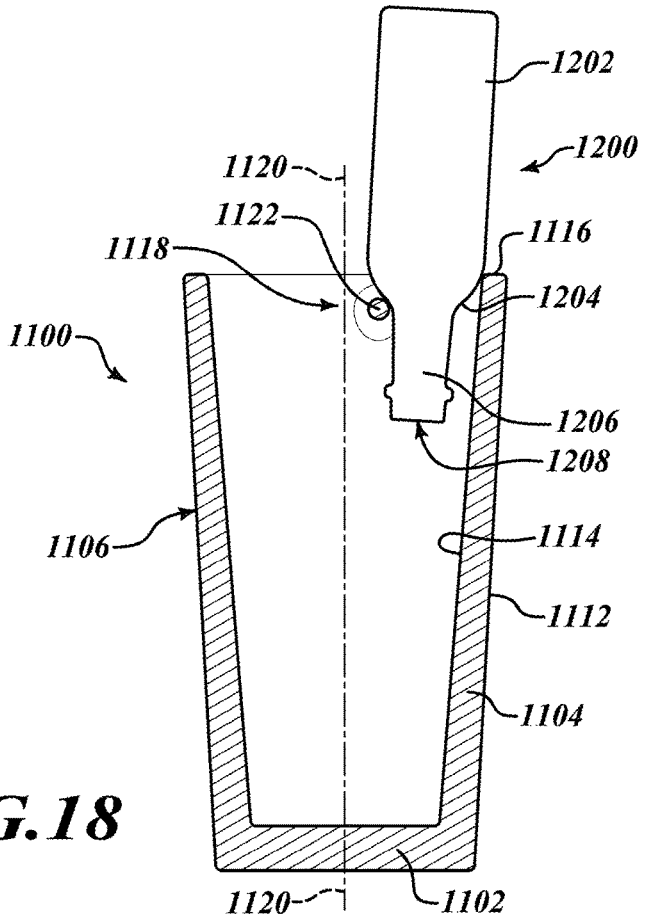
FIG. 18 illustrates a cross-sectional side view of the piece of glassware of FIG. 16, with a bottle coupled to the piece of glassware, taken along line 18-18 in FIG. 17.

FIGS. 16, 17, and 18 illustrate perspective, top, and cross-sectional side views, respectively, of a sixth embodiment of a beverage receptacle or container, which can be a piece of glassware such as a pint glass 1100, and a bottle, which can be a beer bottle or a miniature liquor bottle 1200, supported by the glass 1100. The glass 1100 can share many of the features described above for the glasses 100, 300, 500, 700, and 900, and some common features are not described for the glass 1100 to avoid unnecessary duplication of descriptions. Similarly, the bottle 1200 can share many of the features described above for the bottles 200, 400, 600, 800, and 1000, and some common features are not described for the bottle 1200 to avoid unnecessary duplication of descriptions. The description of glass 1100 and the bottle 1200 that follows focuses on features of glass 1100 and the bottle 1200 that are different from those of glasses 100, 300, 500, 700, and 900 and bottles 200, 400, 600, 800, and 1000.

As shown in FIGS. 16, 17, and 18, the glass 1100 includes a base portion 1102 and a cylindrical wall 1104, which together form a bowl 1106, and which are rotationally, radially, and circularly symmetric about a central longitudinal axis 1120, as well as a support element 1118. The cylindrical wall 1104 of the glass 1100 includes an outer surface 1112, an inner surface 1114, and an upper rim 1116. The support element 1118 can include a bar 1122 that is directly coupled to the inner surface 1114 of the cylindrical wall 1104 at a first location at a first end of the bar 1122, that extends through a central region of the glass 1100, and that is directly coupled to the inner surface 1114 of the cylindrical wall 1104 at a second location at a second end of the bar 1122 that is opposite to the first end of the bar 1122. An opening 1124 is defined between the bar 1122 and portions of the inner surface 1114 and the rim 1116 of the cylindrical wall 1104. The opening 1124 can be configured to allow portions of the bottle 1200 to extend, in an inverted configuration, through the opening 1124.

A method of using the glass 1100 and the bottle 1200 can include pouring one or more primary consumable liquids or beverages into the bowl 1106 of the glass 1100 and filling the bottle 1200 with one or more secondary consumable liquids or beverages, or otherwise providing a pre-filled bottle. The method can also include turning the bottle 1200 upside-down and supporting the bottle 1200 in the upside-down orientation on the bar 1122 and the rim 1116 of the glass 1100, with a mouth 1208 of the bottle 1200 submerged beneath the level of the primary liquids in the bowl 1106 of the glass 1100. For example, the mouth 1208 and a neck 1206 of the bottle 1200 can extend through the opening 1124 while a shoulder 1204 and/or a main body 1202 of the bottle 1200 rest on the bar 1122 and the rim 1116 of the glass 1100, so that the bottle 1200 is supported by the bar 1122 and the rim 1116 in the inverted or upside-down configuration. The method can also include presenting such a beverage to a consumer or customer for consumption. As the consumer drinks or otherwise empties the primary liquids from the bowl 1106, the secondary liquids stored within the bottle 1200 will automatically drain from the bottle 1200 into the bowl 1106 of the glass 1100, where they can mix with the primary liquids. Such a beverage can provide an enjoyable and exciting experience for the consumer.

Although the beverage containers illustrated herein are wine glasses and pint glasses, any of the features described herein can be used in combination with any type of beverage container, including tumblers such as highball glasses, old fashioned glasses, shot glasses, and table glasses, or beer glassware such as beer steins, pilsner glasses, pony glasses, and tankards, or stemware such as absinthe glasses, chalices, champagne coupes, champagne flutes, cocktail glasses, margarita glasses, sherry glasses, and snifters. Furthermore, although the bottles illustrated herein are miniature liquor bottles, any of the features described herein can be used in combination with any type of bottle, including beer bottles or any type of custom-made bottle.

U.S. Pat. No. 9,102,435, issued Aug. 11, 2015, and U.S. design patent application No. 29/562,009, filed Apr. 21, 2016, are hereby incorporated herein by reference in their entireties. Certain specific details are set forth herein in order to provide a thorough understanding of various embodiments of the invention. However, one skilled in the art will understand that embodiments of the invention may be practiced without these details. Moreover, aspects and features of the various embodiments described above can be combined to provide further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A beverage container for supporting an inverted bottle, the beverage container comprising:

a wall defining at least a portion of an interior cavity of the beverage container to receive liquid and having an upper rim at a top end thereof; and a support element that is integrally formed with an inner surface of the wall such that the support element is not detachable from the wall and that extends from the inner surface into the interior cavity of the beverage container, the support element configured to support the inverted bottle such that a mouth of the inverted bottle is within the interior cavity and such that a secondary liquid dispensed through the mouth of the inverted bottle can mix with a primary liquid throughout the cavity, wherein the support element includes an opening sized to support the inverted bottle, and wherein the support element has a straight bar that is coupled at a first end to the inner surface of the wall and that is coupled at a second end opposite to the first end to the inner surface of the wall.

2. A method, comprising:

pouring a primary beverage into a glass having a support element integrally formed therein such that the support element is not detachable from the glass;

filling a bottle with a secondary beverage or otherwise providing the bottle in a pre-filled state;

supporting the bottle in an inverted orientation on the support element integrally formed in the glass, such that a mouth of the inverted bottle is submerged beneath the level of the primary beverage in the glass; and presenting the combination of the glass and inverted bottle to a customer, such that the secondary beverage drains from the bottle into the glass and mixes with the primary beverage as the customer consumes the primary beverage from the glass.

3. A method, comprising:

pouring a primary beverage into a glass having a support element integrally formed therein such that the support element is not detachable from the glass;

filling a bottle with a secondary beverage or otherwise providing the bottle in a pre-filled state;

supporting the bottle in an inverted orientation on the support element integrally formed in the glass, such that a mouth of the inverted bottle is submerged beneath the level of the primary beverage in the glass;

wherein the primary beverage is a margarita and the secondary beverage is an alcoholic beverage.

4. The method of claim 3 wherein the secondary beverage is tequila.

* * * * *